United States Patent [19]

Zilkha

[11] Patent Number: 4,937,975

[45] Date of Patent: Jul. 3, 1990

[54] WINDOW GATE

[76] Inventor: Uri Zilkha, 330 Third Ave., New York, N.Y. 10010

[21] Appl. No.: 374,772

[22] Filed: Jul. 3, 1989

[51] Int. Cl.[5] ..... E06B 3/68

[52] U.S. Cl. ..... 49/56; 49/55; 49/395; 292/143; 292/161

[58] Field of Search ..... 49/50, 55, 56, 169, 49/170, 394, 395; 292/143, 161, 173

[56] References Cited

U.S. PATENT DOCUMENTS

| | | | |
|---|---|---|---|
| 1,438,547 | 12/1922 | O'Connor | 292/161 |
| 1,515,612 | 11/1924 | O'Connor | 292/161 X |
| 3,722,236 | 3/1973 | Zelenko | 292/161 |
| 4,249,345 | 2/1981 | Littleton | 49/56 |
| 4,274,228 | 6/1981 | Kondracki | 49/56 |
| 4,452,011 | 6/1984 | Trombettas | 49/56 |
| 4,575,965 | 3/1986 | Iversen | 49/50 |
| 4,624,072 | 11/1986 | Zilkha | 49/55 |
| 4,630,396 | 12/1986 | Zvi et al. | 49/55 |
| 4,677,789 | 7/1987 | Merry | 49/395 X |

*Primary Examiner*—Gary L. Smith
*Assistant Examiner*—Michael J. Milano
*Attorney, Agent, or Firm*—Charles E. Temko

[57] ABSTRACT

An improved lockable window gate including an outer frame element adapted to be secured within a window frame and a swingable gate element pivotally mounted upon the frame element and having a locked coplanar position. An improved locking mechanism provides for multiple locking locations therebetween, thus making the forcing of the gate more difficult. The overall dimensions of the frame element are adjustable to accommodate window openings of variable height and width by means of telescopic elements above and to one side of the gate element.

1 Claim, 4 Drawing Sheets

WINDOW GATE

BACKGROUND OF THE INVENTION

This invention relates generally to the field of window gates which are installed in the openings of conventional double hung windows in locations having relatively high incidence of crime, and more particularly to an improved form thereof offering improved adjustability, and, more importantly, improved security with respect to the locking elements thereof.

In gates of this type, it is not practicable to provide locking means requiring a key, since upon the occurence of an emergency, it is usually necessary for the occupants of the building to have immediate egress accessibility. As described in prior U.S. Pat. No. 4,274,228 granted June 23, 1981, it is known to configure the gate to include a shield over the locking mechanism, whereby access to the same from the outside of the building is impossible, while access to an occupant of the building is readily available.

In my above-mentioned patent, the locking mechanism comprises a single axially shiftable bolt which provides, in essence, a single locking point. While not inadequate for resisting most intruders, it is possible to overcome this single locking means in some instances using a combination of hand-held tools and sufficient patience.

Another disadvantage of my prior construction lies in the provision of an adjustable member in the form of a piece of angle iron, which is not only unattractive, but which tends to block the passage of light through the window in the area in which the angle iron is located. Additionally, it does not match the grill work of the remaining parts of the gate, and is esthetically less appealing.

SUMMARY OF THE INVENTION

Briefly stated, the invention contemplates the provision of an improved window gate of the class described, in which the above-mentioned disadvantages have been substantially corrected. To this end, each of the disclosed embodiments is provided with multiple points of mutual locking engagement between the relatively fixed frame element and the hingedly mounted gate element. In the case of a first embodiment, the locking mechanism includes a slideably mounted elongated element having locking recesses along the axial length thereof which selectively coact with corresponding projections on a peripheral member of the frame element. Additionally, the elongated element projects axially at a lower end thereof into an opening in a horizontally disposed member of the frame element to provide an additional locking point.

In a second disclosed embodiment, there are provided plural bolt-like members in spaced parallel relation on the gate element which engage corresponding openings in the frame element. An elongated pivotally mounted operating rod is manually accessible to a building occupant through an opening in a shield at one point therealong. Rotation of the rod causes multiple crank-like offset members to simultaneously move all of the bolt-like members between engaged and disengaged position.

In both embodiments, adjustment means is provided which eliminates the separate angle iron construction of my earlier design, and substitutes a movable section of the frame element in each of two directions which telescope with respect to the remaining portions of the frame element, and thus significantly improve light transmission through the movable sections in addition to improving the esthetic appearance of the device.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
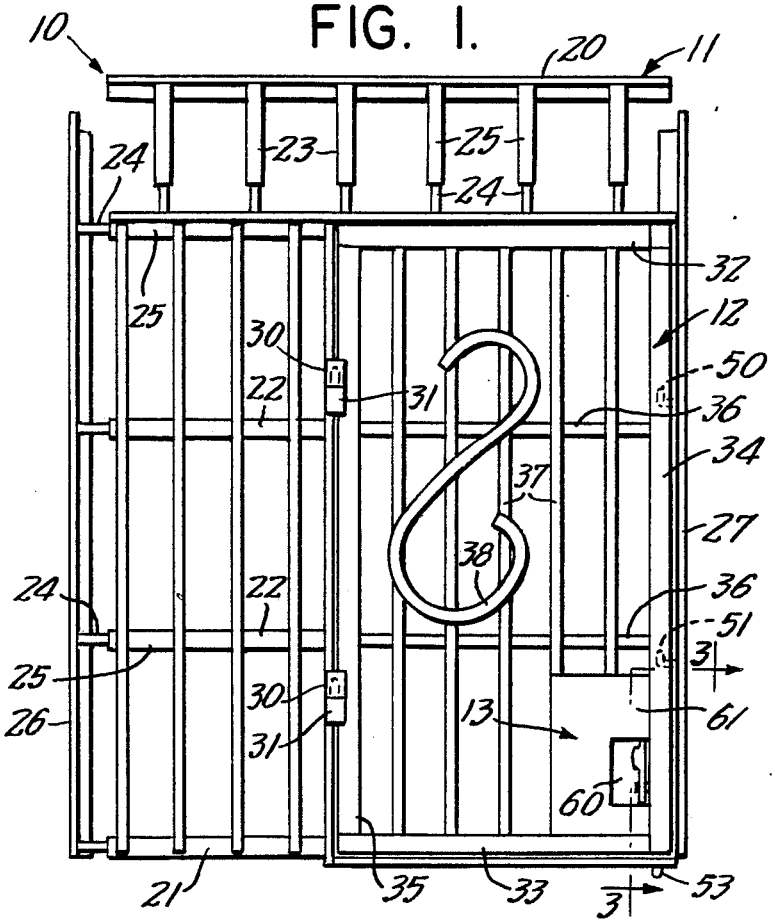
FIG. 1 is an elevational view of a first embodiment of the invention showing the device thereof facing the interior of a window opening.
Figure 2:
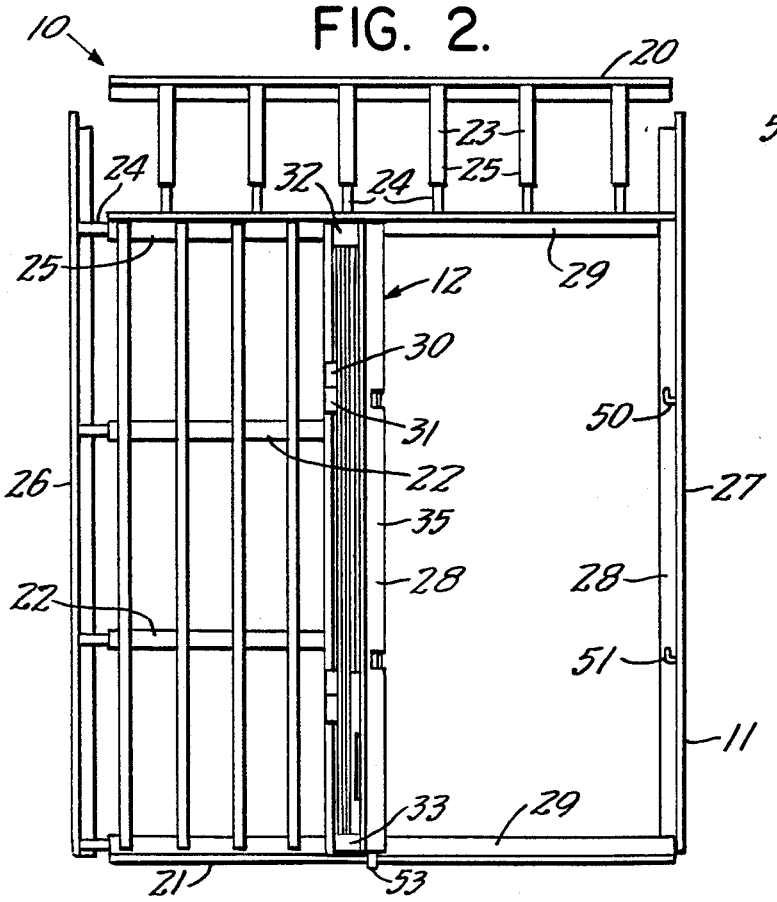
FIG. 2 is a similar elevational view thereof showing the gate element in opened condition.
Figure 3:
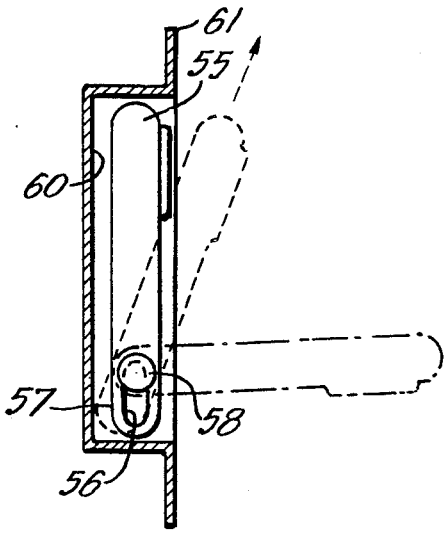
FIG. 3 is an enlarged fragmentary vertical sectional view as seen from the plane 3—3 in FIG. 1.

In accordance with the invention, the first embodiment thereof, generally indicated by reference character 10, comprises broadly, a relatively fixed frame element 11, a pivotally mounted gate element 12, and a manually operated locking mechanism 13. As is customary with window gates of the disclosed type, the locking mechanism 13 is so configured and shielded as to make the same accessible only to a person located inwardly of the window opening in which the device is installed.

The fixed frame element 11 is preferably formed of welded angle iron or similar material, and includes upper and lower end rails 20 and 21, respectively, a plurality of medially positioned horizontal members 22, a plurality of medially positioned vertical members 23, each including telescopic male and female parts 24 and 25, respectively. Side rails 26 and 27, together with end rails 20 and 21 are normally secured within a window opening by lag screws, expansion bolts, or the like (not shown). Fixed vertical and horizontal rails 28 and 29 define a rectangular opening in which the gate element 12 is movable positioned.

The gate element 12 is also preferably of welded steel construction and includes open-ended hinge means 30 which cooperates with pintles 31 on the frame element so that the gate element may be manually disconnected during installation. It includes upper and lower edge members 32 and 33, first and second vertical members 34 and 35, horizontal medially positioned members 36 and medially positioned vertical members 37 as well as an optional decorative member 38.

The locking mechanism 13 includes a hollow channel-forming member which may be a part of the vertical member 34 in which the channel 40 communicates with plural composite slot openings 41 and 42, each including a vertical portion 43 and a horizontal portion 44. A lower vertical slot 45 provides for manual operation, as will appear hereinafter. Disposed within the channel is an elongated bar 47 having corresponding openings 48 and 49.

The frame element 11 is provided with curved projections 50 an 51 which are engaged by the edges of the openings 48 and 49 to effect a locking action. The lower end of the bar 52 mounts a pintle 53, the lower end of which engages an orifice 54 in the horizontal member 22 to effect an additional locking point.

Figure 4:
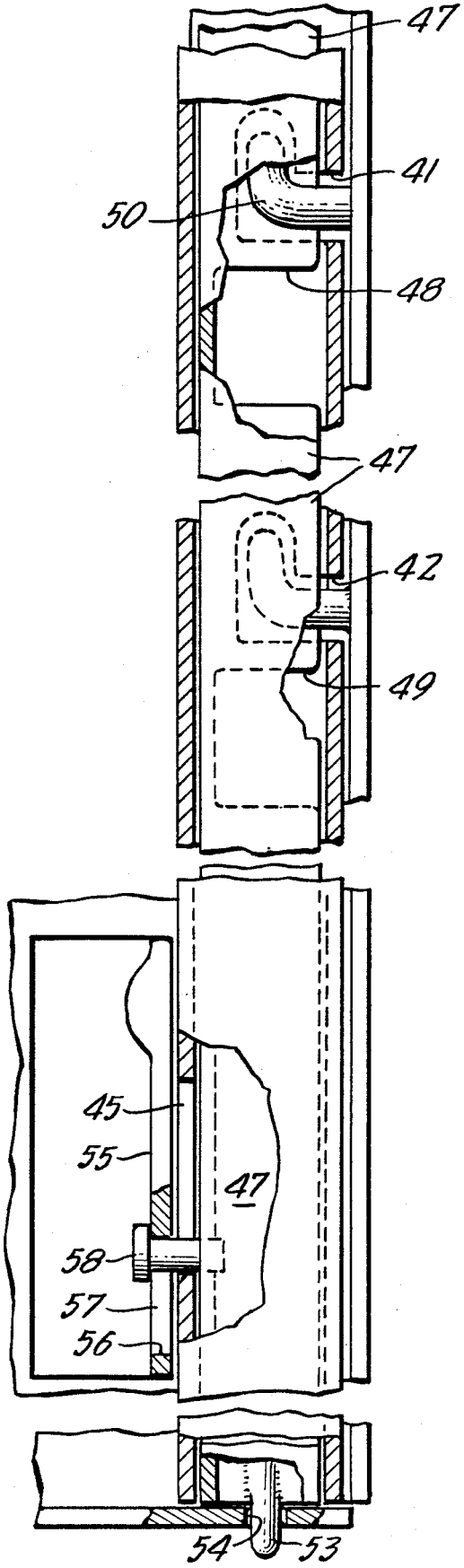
FIG. 4 is a fragmentary enlarged vertical sectional view corresponding to the right-hand edge portion of FIG. 1.
Figure 5:
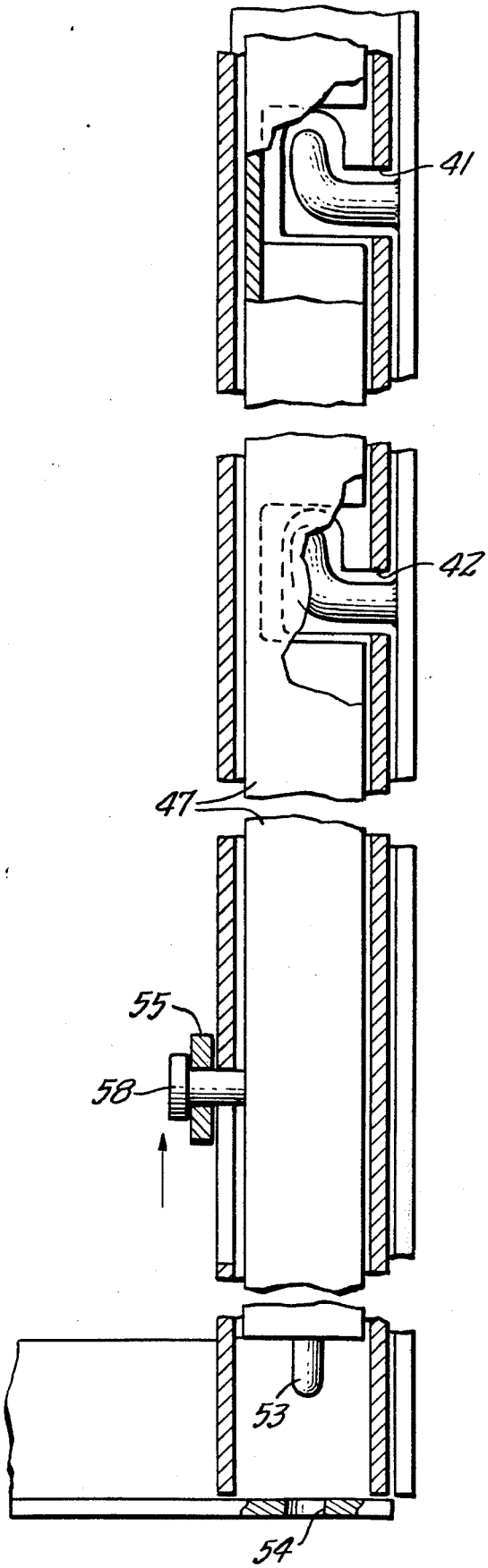
FIG. 5 is a fragmentary enlarged vertical sectional view corresponding to that seen in FIG. 4, with certain of the component parts in altered relative position.
Figure 6:
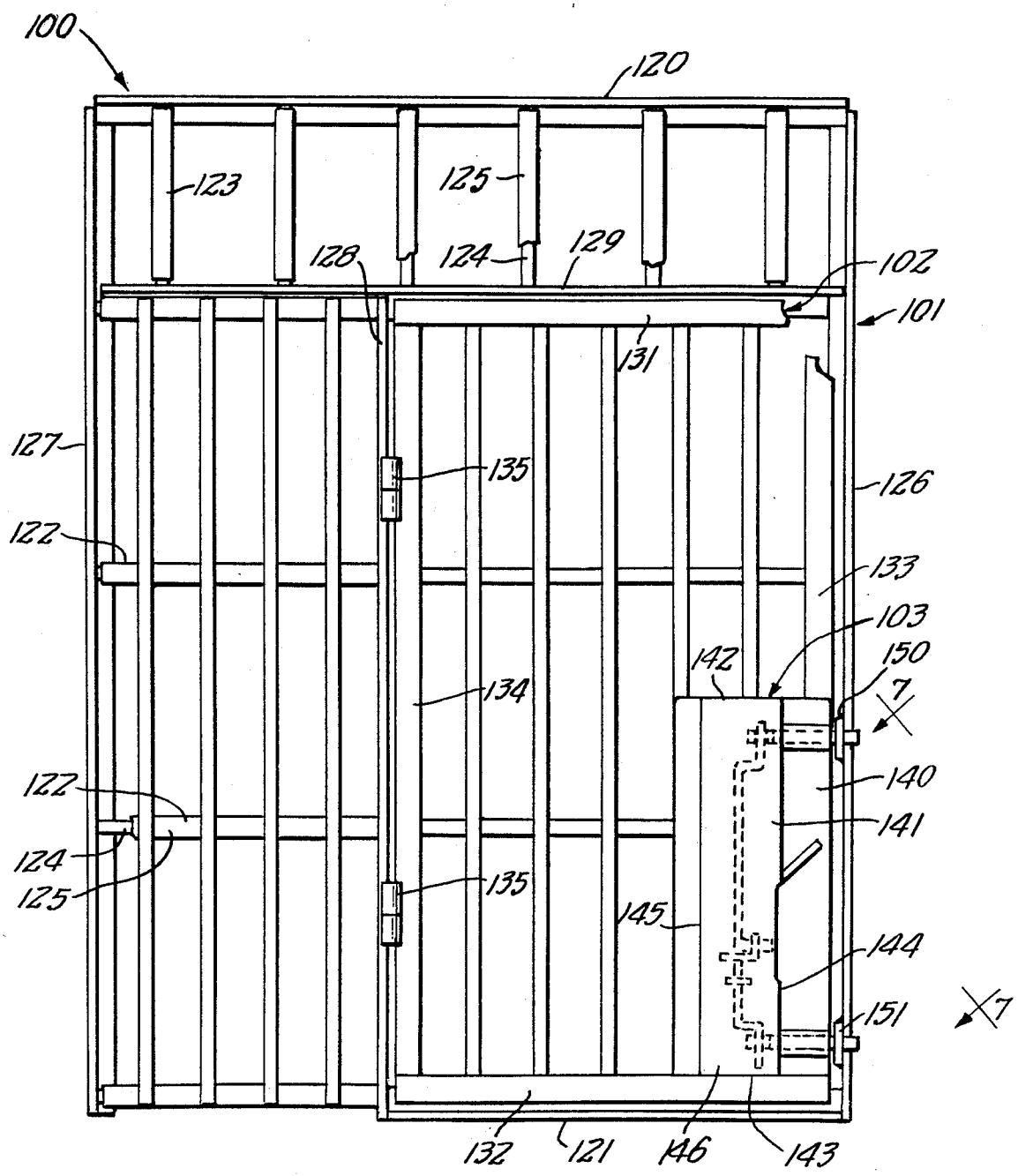
FIG. 6 is a view in elevation corresponding to that seen in FIG. 1, but showing a second embodiment of the invention.
Figure 7:
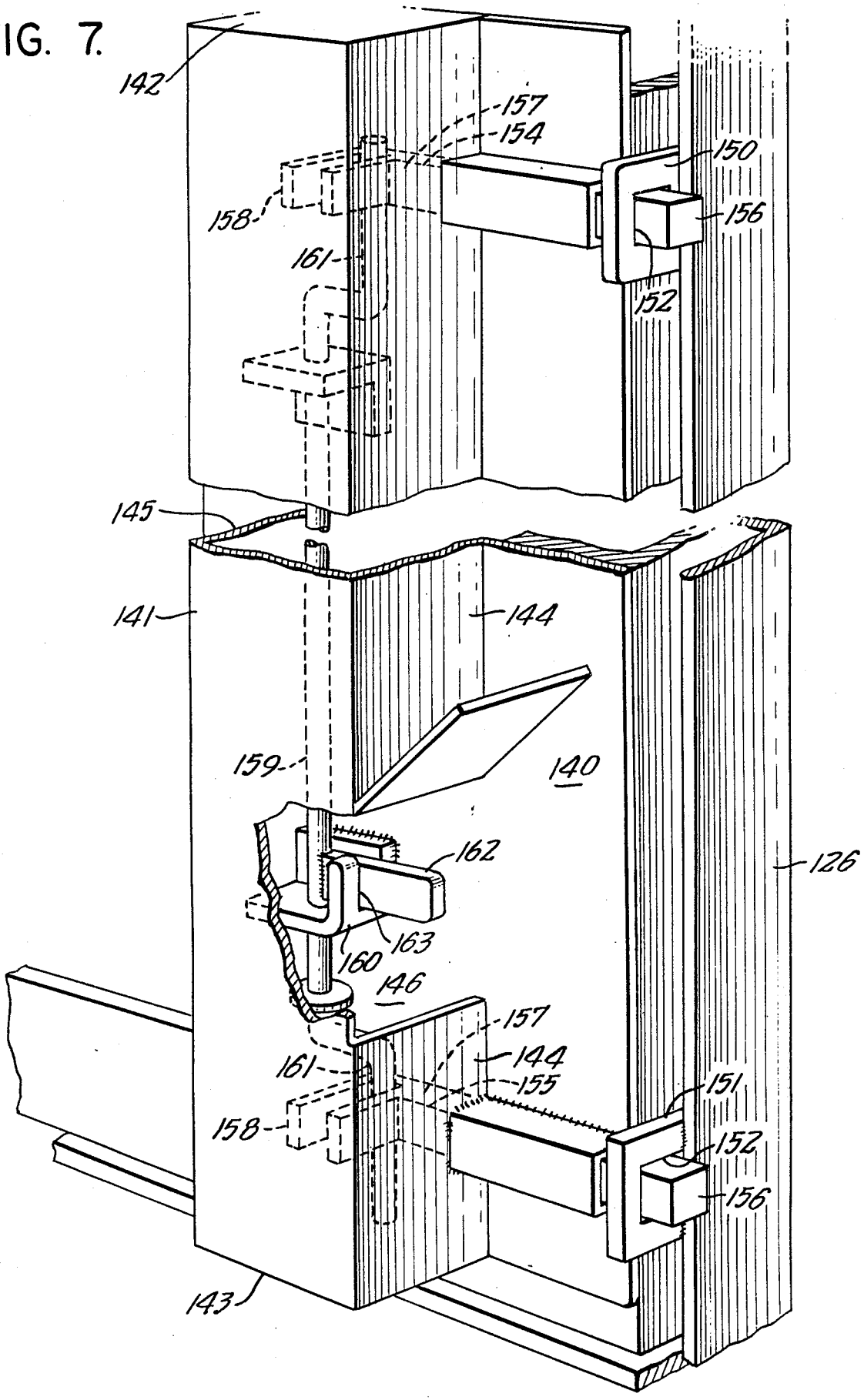
FIG. 7 is an enlarged fragmentary view in perspective as seen from the plane 7—7 in FIG. 6.

An operating lever 55 includes a slotted opening 56 at a lower end 57 thereof which engages a pintle 58 on the bar 47. The lever is positioned within a rectangular recess 60 in a rectangular plate 61 which is welded to the inner surface of the gate element 12. From a consideration of FIGS. 4 and 5, it will be apparent that in order to unlock the gate element with respect to the frame element, it is necessary to move the lever 55 directly upward until the lower end 57 of the slot 56 is in contact with the pintle 58, at which point it may be pivoted outwardly of the recess toward the building occupant, who can then move the bar 47 in an upwardly vertical direction to effect unlocking, following which the gate element 12 may be swung out of the plane of the frame element to offer egress to the occupant in the case of an emergency.

It will be apparent to those skilled in the art that my present construction offers multiple locking points, as contrasted with a single locking point in the case of devices made in accordance with my earlier above mentioned patent. Thus, the locking mechanism is not readily defeated by an intruder using a crowbar or other hand held tool.

Turning now to the second embodiment of the invention, generally indicated by reference character 100, this embodiment differs from the first embodiment in the provision of laterally movable bolt members operated by a vertically moving rod having offset crank members which actuate the bolts. The second embodiment includes a fixed frame element 101, a pivotally mounted gate element 102, and locking mechanism 103.

The frame element 101 is constructed in a manner generally similar to that of the first embodiment, and includes an upper end rail 120, a lower end rail 121, medially positioned horzontal members 122, medially positioned vertical members 123, each including corresponding male and female sections 124 and 125. Interconnecting the rails 120 and 121 are side rails 126 and 127. A medial vertical rail 128 and medial horizontal rail 129 define a rectangular opening for the gate element 102.

The gate element 102 includes upper and lower end rails 131 and 132, first and second vertical rails 133 and 134, the latter mounting hinged sockets 135.

The locking mechanism 103 differs from the locking mechanism 13 of the first embodiment in that the operating rod is capable not only of axial movement, but rotational movement as well, thereby enabling the use of locking bolts which are somewhat stronger than the locking projections of the first embodiment. The element 103 includes a mounting plate 140 supporting a hollow housing 141 bounded by an upper end wall 142, a lower end wall 143, side walls 144 and 145 and an inner wall 146. Member 126 supports inwardly extending projections 150 and 151, each having an orifice 152 for reception of a locking bolt. The housing 141 supports first and second sliding bolt members 154 and 155, each having an outer end 156 engaging the orifices 152. An inner end 157 mounts a U-shaped bracket 158. An operating rod 159 moves parallel to the side rail 144 within a supporting bracket 160. The rod has plural offset cranks which engage the brackets 158, and an operating handle 162 normally positioned within a locking recess 163 in the bracket 160.

To unlock the gate element 102 with respect to the frame element 101, the operating handle 162 is manually engaged, and the rod 159 moved as if it were a locking bolt. As the handle 162 is rotated, movement is transmitted through the cranks 161 to the brackets 158 to result in withdrawing the bolt members 154 and 155. In this manner, it is possible with a single movement on the part of the building occupant to simultaneously open plural locking bolt engagements, thus materially reducing the degree of manipulation necessary, which is often so vital in the case of emergencies such as fire.

It may thus be seen that I have invented novel and highly useful improvements in window gate locking construction, in which increased security is provided by providing plural locking points all of which can be opened or closed simultaneously as a result of a single movement on the part of the operator.

I wish it to be understood that I do not consider the invention to be limited to the precise details of structure shown and set forth in this specification, for obvious modifications will occur to those skilled in the art to which the invention pertains.

I claim:

1. In a window gate having a relatively fixed frame element adapted to be installed in a window opening, and a pivotally mounted gate element supported within an opening in said frame element, the improvement comprising: manually operated locking means for securing said gate element in coplanar relation with said frame elements; said locking means including a hollow elongated channel-forming member on a vertical edge of said gate element, said channel-forming member having an opening therein for access to the interior thereof by a user, said opening being accessible from only one side of said frame element, and a plurality of openings medially disposed within said channel-forming member; an elongated bar slideably disposed within said channel-forming member for manual axial movement between first and second positions, means on said bar for manual engagement therewith for such movement, said bar having plural locking means positioned therealong selectively alignable each with one of said plural openings; corresponding plural locking means on said frame element positioned opposite said plural openings in said channel-forming member when said gate element is in coplanar relation with said frame element, movement of said bar to one of said first and second positions serving to engage said plural locking means on said bar with said corresponding locking means on said frame element; said locking means and said bar including a plurality of offset crank portions, said gate element mounting plural laterally movable bolt members, each having means on one end thereof engaging said crank portions, said frame element having plural openings therein selectively engaging free second ends of said bolt members; said bar being mounted for both axial and rotational movement, rotational movement serving to move said bolts between engaged and disengaged condition relative to said plural openings, and translational movements serving in one position thereof to fix the rotational position thereof.

* * * * *